United States Patent [19]

Adamson

[11] Patent Number: 4,729,395

[45] Date of Patent: Mar. 8, 1988

[54] WALKING AID

[76] Inventor: Alistair H. M. Adamson, 5 Park Road, Farnham, Surrey, England

[21] Appl. No.: 882,211

[22] Filed: Jul. 3, 1986

Related U.S. Application Data

[63] Continuation of Ser. No. 696,868, Jan. 30, 1985, abandoned, which is a continuation of Ser. No. 374,304, May 3, 1982, abandoned.

[30] Foreign Application Priority Data

May 5, 1981 [GB] United Kingdom ..... 81/3656

[51] Int. Cl.[4] ..... A61H 3/04

[52] U.S. Cl. ..... 135/67; 272/70.3; 135/74

[58] Field of Search ..... 135/67, 74; 272/70.3, 272/70.4; 297/5, 6; 280/647, 648, 649, 650, 87.02 R, 87.02 W, 47.26, 47.38, DIG. 6; D12/128, 129, 130; D34/15; D3/5, 6, 7, 8

[56] References Cited

U.S. PATENT DOCUMENTS

| | | | |
|---|---|---|---|
| 2,656,874 | 10/1953 | Robb | 135/67 |
| 2,733,754 | 2/1956 | Leslie et al. | 272/70.4 X |
| 2,734,554 | 2/1956 | Ries | 135/67 X |
| 2,866,495 | 12/1958 | Diehl et al. | 297/6 |
| 2,996,070 | 8/1961 | Ries | 135/67 |
| 3,390,893 | 7/1968 | MacLaren | 280/650 X |
| 3,442,276 | 5/1969 | Edwards et al. . | |
| 3,840,034 | 10/1974 | Smith . | |
| 4,046,374 | 9/1977 | Breyley | 272/70.3 |
| 4,164,354 | 8/1979 | Rodaway et al. . | |
| 4,180,086 | 12/1979 | Thomas | 135/74 X |
| 4,232,897 | 11/1980 | MacLaren | 280/647 X |
| 4,251,044 | 2/1981 | Olson | 135/67 X |
| 4,253,678 | 3/1981 | Leclerc | 297/6 X |
| 4,341,381 | 7/1982 | Norberg | 135/74 X |
| 4,481,965 | 11/1984 | Watkins | 135/74 X |

FOREIGN PATENT DOCUMENTS

| | | | |
|---|---|---|---|
| 0010453 | 4/1980 | European Pat. Off. . | |
| 1270221 | 6/1968 | Fed. Rep. of Germany | 272/70.3 |
| 2321270 | 8/1976 | France . | |
| 919044 | 2/1963 | United Kingdom | 135/67 |
| 1561038 | 8/1975 | United Kingdom . | |
| 1529343 | 8/1975 | United Kingdom . | |
| 1535600 | 6/1976 | United Kingdom . | |
| 1525878 | 11/1976 | United Kingdom . | |
| 2003385 | 8/1978 | United Kingdom . | |
| 2012571 | 1/1979 | United Kingdom . | |
| 2023414 | 6/1979 | United Kingdom . | |

*Primary Examiner*—Richard J. Johnson

*Attorney, Agent, or Firm*—Cushman, Darby & Cushman

[57] ABSTRACT

A walking aid for handicapped persons comprises a collapsible frame having a first pair of support members pivotally connected to each other approximately at their mid-points for executing a scissor action when the frame is to be collapsed. A second pair of support members are coupled to the upper portions of the members of the first pair by hinged joints each having two axes of rotation, and in the operative state are spaced from the first pair of support members by hinged bracing struts. A centrally hinged transverse bracing member holds the hinged joints and patient support handles apart in the operative state. The frame is collapsed by folding the transverse bracing member and bringing the handles together, thereby causing the first pair of support members to execute a scissor action which automatically brings the rear feet towards the front feet, resulting in particularly compact collapsed structure.

15 Claims, 10 Drawing Figures

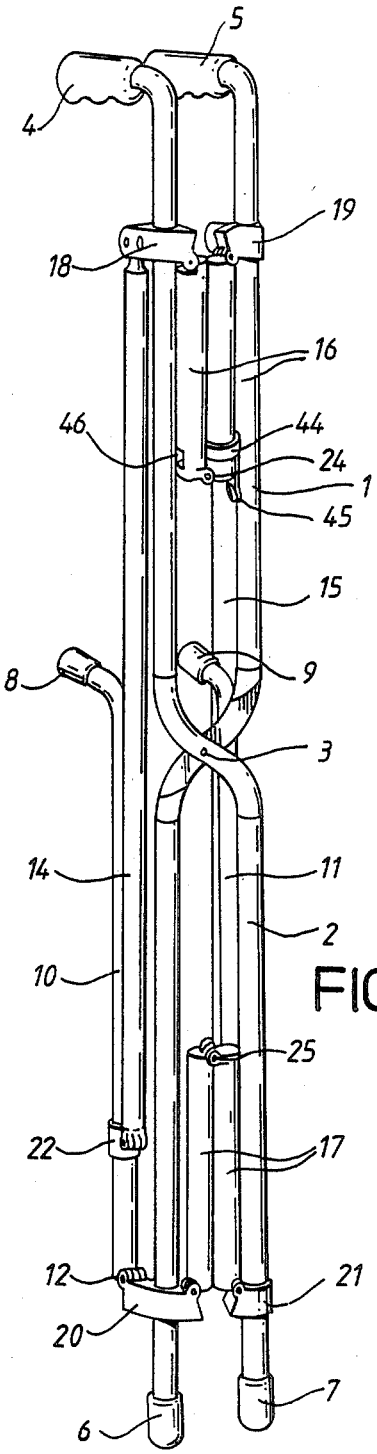
FIG.2.
FIG.3.
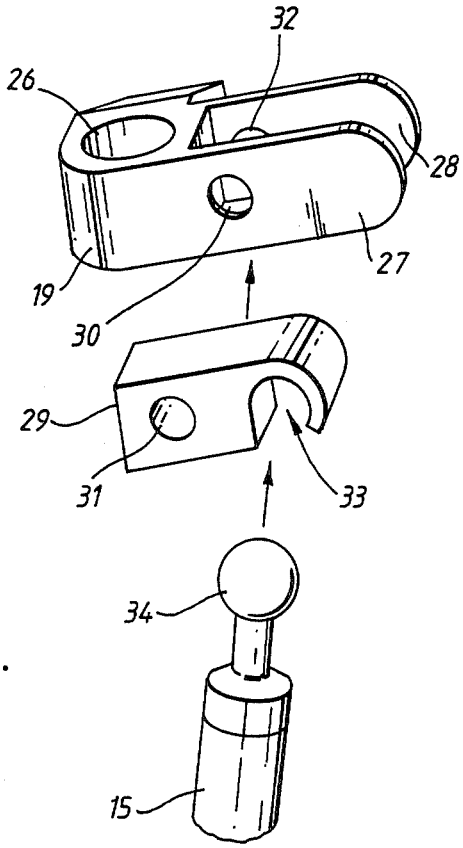

WALKING AID

This is a continuation of application Ser. No. 696,868, filed Jan. 30, 1985 and abandoned in favor hereof, which was a continuation of application Ser. No. 374,304, filed May 3, 1982 and abandoned in favor thereof.

BACKGROUND OF THE INVENTION

This invention relates to a structure for supporting a handicapped person when standing and walking.

Structures of this type, commonly referred to as walking frames, are used by disabled or handicapped persons as an aid to walking, for raising themselves from a sitting position, or for climbing stairs. Known walking frames generally comprise a metal tubular framework having three or four legs and two support handles. The framework is usually rigid to provide a firm support and to stabilise the user when he applies his weight. However, such walking frames are often made of a relatively heavy material such as steel tubing, and being rigid, they are bulky and therefore awkward to store and awkward to manoeuvre in confined spaces. These disadvantages arise particularly if the user wishes to transport the frame by bus or in a car.

Folding walking frames are known, but the extent to which they can be collapsed is limited so that they are still relatively awkward and bulky to handle.

It is an object of this invention to provide a collapsible support structure which is relatively compact when collapsed and also relatively light in weight.

SUMMARY OF THE INVENTION

According to one aspect of this invention a support frame for aiding a disabled person comprises a plurality of hinged elongate members arranged to form a three dimensional structure when in an operative state, which structure can be collapsed to a less bulky collapsed state in which at least two of the dimensions are substantially less than they are in the operative state by hinging the members relative to each other.

In a preferred embodiment of the invention the structure is based on a pair of support members hinged approximately at their mid-points to form an 'X' when the frame is in its operative state. Handles are attached or linked to the upper ends of the 'X' so that when they are brought together the two support members pivot relative to each other in a scissor action so that the overall width of the structure reduces until the two members are generally parallel to each other. This latter configuration defines the collapsed state.

The members forming the 'X' constitute the front part of the frame and support a pair of front feet at their lower ends. The rear part of the frame is formed by a second pair of support members which are dependent from the upper portions of the members forming the 'X' and support a pair of rear feet. Front-to-rear bracing members connect the lower portions of the members and are arranged to draw the second pair of members towards the members forming the 'X' as the handles are brought together. This results in a collapsed structure in which all the major elongate component members are parallel to each other, forming a relatively compact unit of a width and depth both much less than its length. In the collapsed condition it is relatively easily handled and relatively easily stowed, for example, on board a vehicle. It is also possible to use the collapsed frame as a walking stick, and as such is particularly useful when climbing stairs or passing through small gaps.

The frame may be provided with wheels or rollers to aid manoevrability, and, in conjunction with these, automatic brakes. It may also incorporate a seat. A shopping basket could be attached to the frame.

BRIEF DESCRIPTION OF THE DRAWINGS

Two embodiments of the invention are illustrated by way of example in the accompanying drawings in which:

FIG. 2 is a perspective view of the frame of FIG. 1 in the collapsed state;

FIG. 3 is an exploded perspective view of one of the joints of the first frame;

DETAILED DESCRIPTION OF PREFERRED EMBODIMENTS

Figure 1:
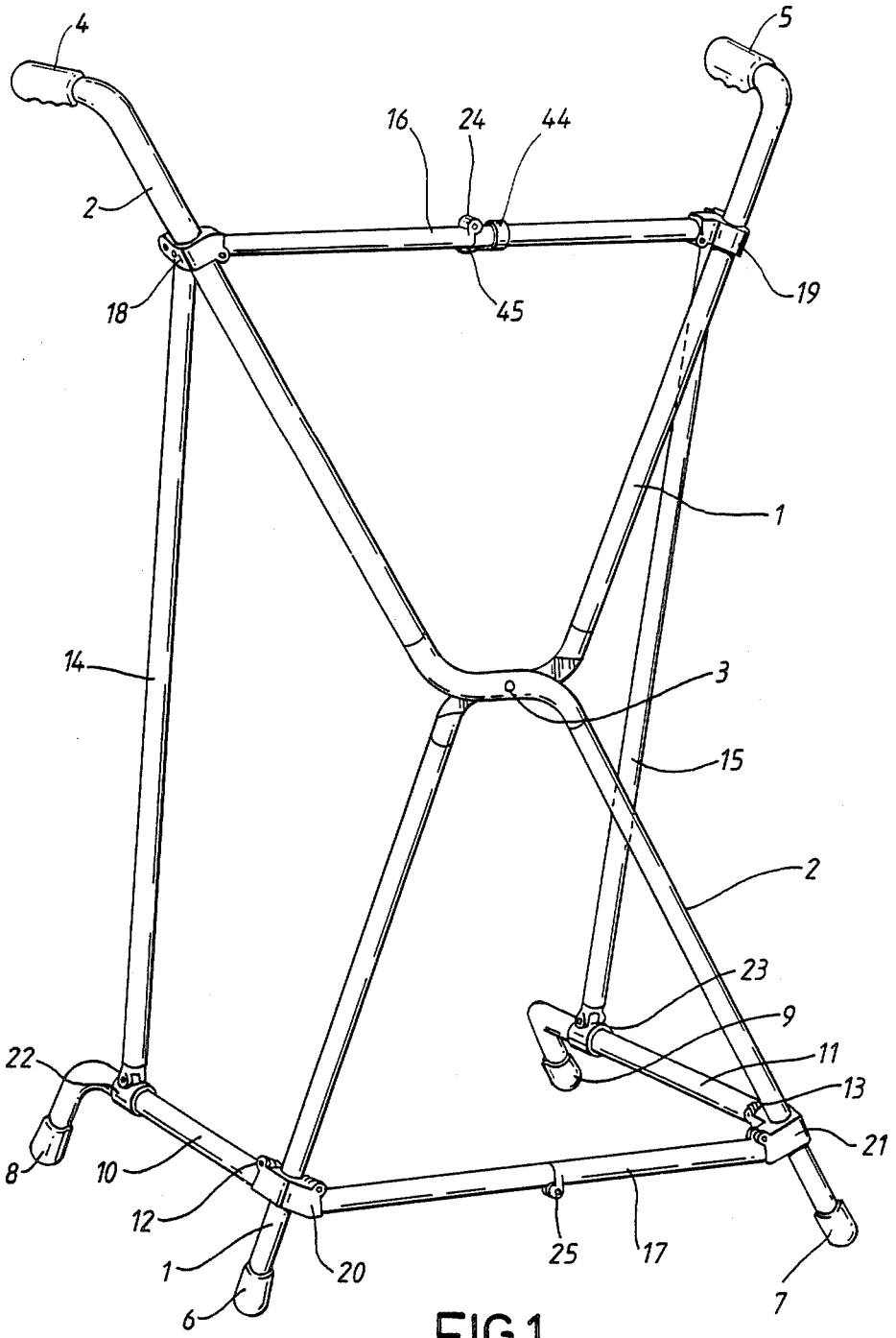
FIG. 1 is a perspective view of a first walking frame in the operative state.

Referring to FIG. 1, a first walking frame in accordance with the invention is a three-dimensional structure comprising a pair of generally upright members 1 and 2 pivotally connected at a central pivot 3 to form an 'X". The top ends of the members 1 and 2 have handles 4 and 5, and the lower ends are protected by rubber feet 6 and 7. The handles may be vertically adjustable on the members 1 and 2. The feet 6 and 7 are the front feet of the structure; rear feet 8 and 9 are provided at the rear ends of a pair of generally horizontal members 10 and 11 which are attached to the lower portions of the upright members 1 and 2 by hinged connections 12 and 13. Support members 14 and 15 connect the top portions of the upright members 1 and 2 to the rear portions of the horizontal members 10 and 11. Two centrally hinged bracing members 16 and 17 hold the members 1 and 2 in their operative 'X' configuration.

Hinged connections are provided at the ends of the bracing members 16 and 17, preferably by moulded nylon blocks 18 to 21 fixed on the upright members 1 and 2. The upper pair of blocks 18 and 19 also incorporate ball and socket hinged joints (described below) for connecting to the upper ends of the support members 14 and 15, and the lower pair of blocks 20 and 21 incorporate and hinge connections 12 and 13. Connection of the support members 14 and 15 to the horizontal members 10 and 11 is made by means of hinged joints mounted on respective nylon sleeves 22 and 23 which are slidable on the members 10 and 11.

The structural members and struts are preferably manufactured from aluminium alloy tubing for lightness.

The central hinged joint 24 of the bracing member 16 is automatically locked by lock 44 when the frame is in its operative state. A resilient tongue 45 attached to one half of the number 16 by a ring has a latch member which engages a notch 46 (see FIG. 2) in the underside of the other half of the member 16 when the hinged joint reaches the position shown in FIG. 1. The lock is released by pushing down on the end of the tongue 45.

Folding of the frame to the fully collapsed state as shown in FIG. 2 is accomplished by releasing the lock 44 on the strut 16, lifting the central hinge 25 on the strut 17, and pulling the handles 4 and 5 together. The front, upright members 1 and 2 execute a scissor action, and the horizontal members 10 and 11 hinge upwardly about their front hinges 12 and 13. The sleeves 22 and 23 move forwardly along the horizontally members, so that in the fully collapsed state all the structural members lie generally parallel to each other as shown in FIG. 2. In this state the structure is relatively compact and therefore easily transported.

The ball and socket joint included in the connection block 19 is shown more clearly in FIG. 3. The block 19 has a main bore 26 for housing the upright member 1 and a pair of tongues 27 and 28, which extend rearwardly of the member 1 when mounted. A nylon insert 29 fits between the two tongues and is held in position by means of a bolt or dowel (not shown) housed in the holes 30 to 32 in the tongues and insert. The insert 29 has a recess 33 for housing a ball member 34 mounted on the upper end of the support member 15, so that when the insert is fitted between the tongues 27 and 28 it is trapped in the recess.

Figure 4:
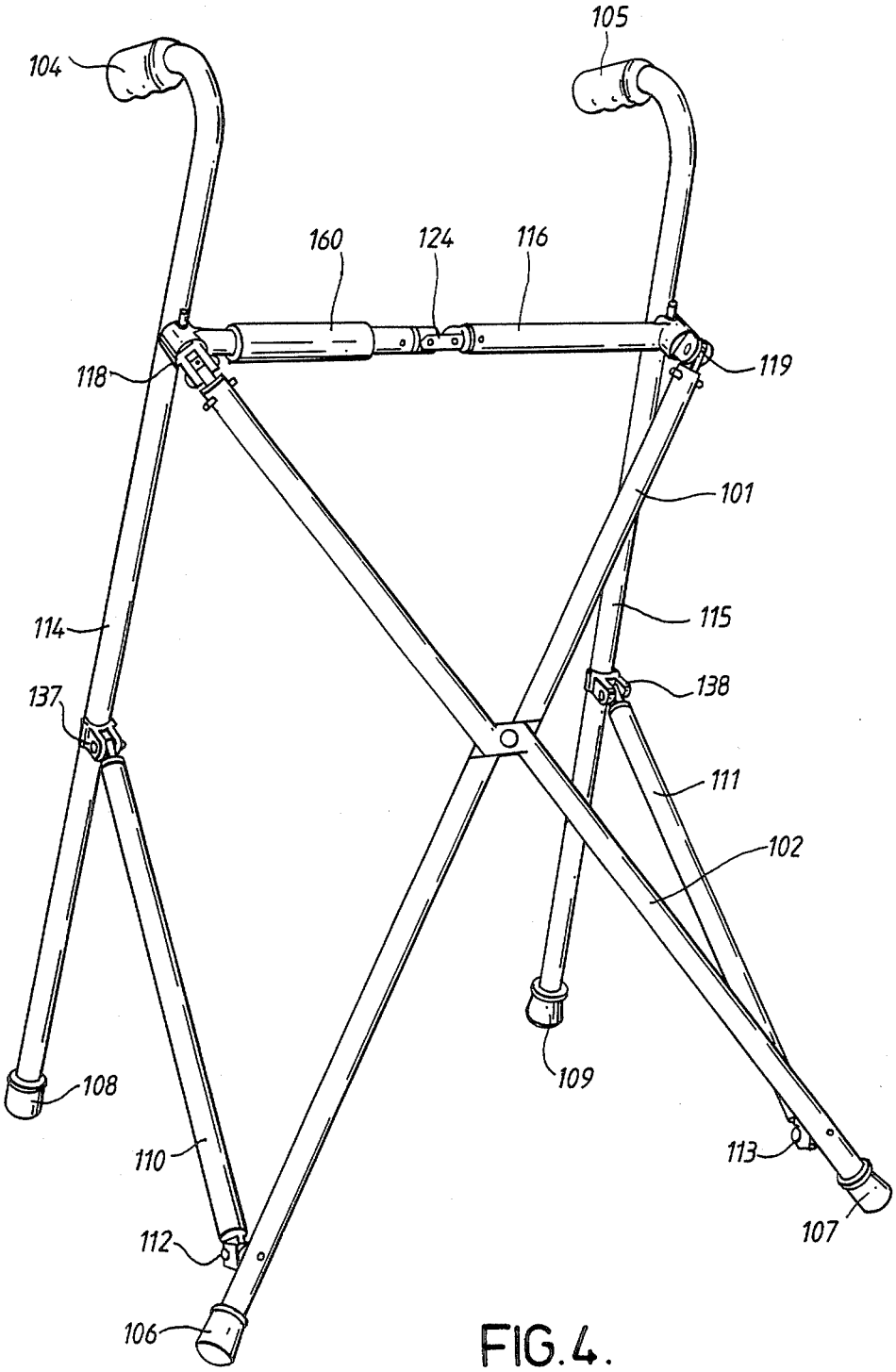
FIG. 4 is a perspective view of an alternative embodiment in accordance with the invention, shown in its operative state.
Figure 5:
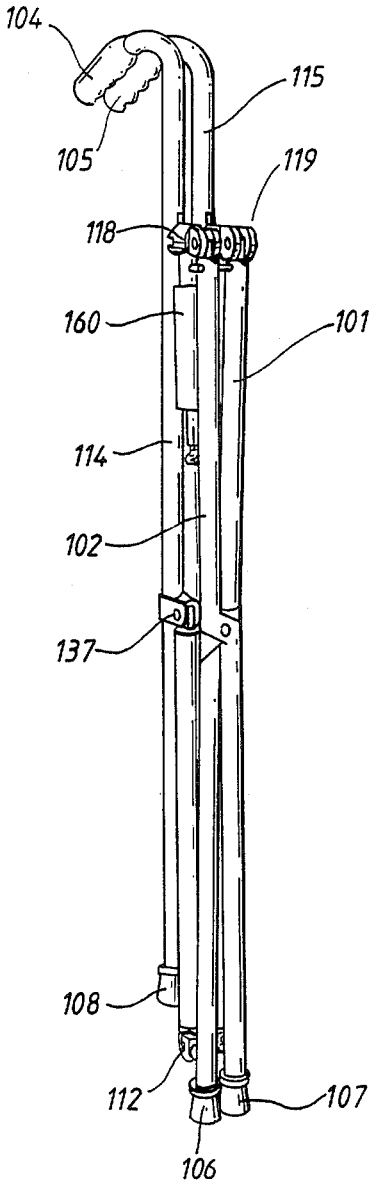
FIG. 5 is a perspective view of the frame of FIG. 4 in its collapsed state.
Figure 6:
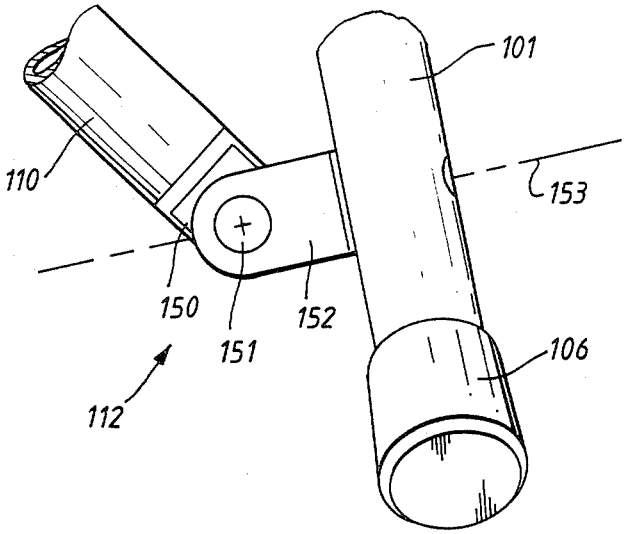
FIG. 6 is a side view of one of the feet of the embodiment of FIG. 4.

In an alternative embodiment shown in FIGS. 4 and 5 the support members 114 and 115 extend beyond the upper hinged joints 118 and 119 to form handles 104 and 105, the scissor members 101 and 102 terminating at the upper hinged joints. The lower ends of the rear support members 114 and 115 now form rear feet 108 and 109, and are located relative to the scissor members 101 and 102 by inclined front to back bracing struts 110 and 111. Each of these bracing struts has a forward hinged joint 112 or 113 which is pivotally mounted on a respective scissor member 101 or 102, and a rearward hinged joint 137 or 138. The forward hinged joint 112 is shown in more detail in FIG. 6, from which it will be seen that the strut 110 terminates in a tongue 150 located by a pin 151 between the arms of a U-shaped member 152 mounted on the scissor member 101. The geometry of the frame of this embodiment dictates that the member 152 shall be pivotable about an axis 153 to allow the frame to collapse without strain on the joints.

Figure 7:
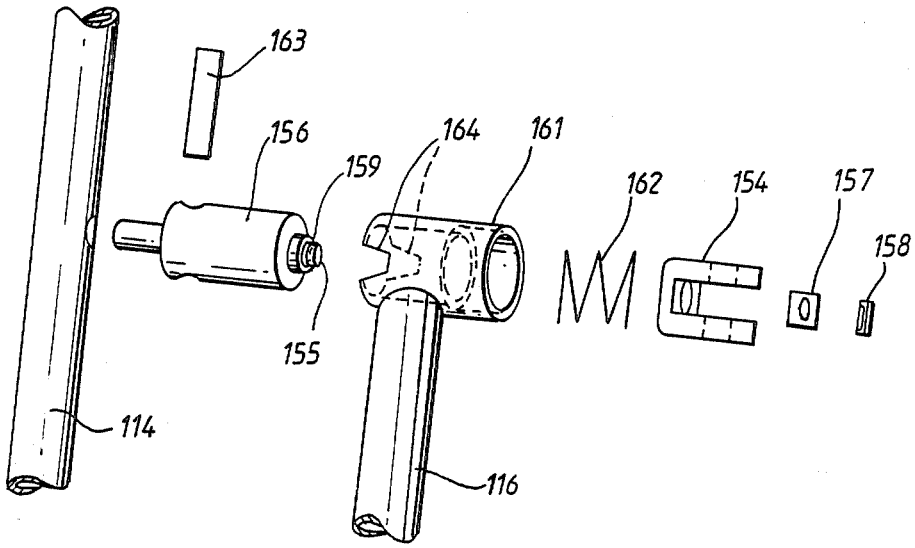
FIG. 7 is an exploded perspective view of a hinged joint of the embodiment of FIG. 4.

Connection of the scissor members 101 and 102 to the upright support members 114 and 115 is such that each scissor member can rotate about two axes of rotation relative to the respective support member. Referring to FIG. 7 which is an exploded perspective view of the joint 118, a U-shaped member 154 is pivotally mounted on a pin 155 projecting from the end of the cylindrical stub 156 fixed to the support member 114. The U-shaped member 154 is held in position by a washer 157 and a U-shaped spring clip 158 dimensioned to slide between the arms of the U-shaped member 154 to engage a groove 159 on the pin 155. The upper end of the scissor member 101 fits between the arms of the U-shaped member 154. Referring back to FIG. 4, the top portions of the scissor members 101 and 102 and rear support members 114 and 115 are held apart in the operative position by a centrally hinged transverse bracing member 116, the central hinge 124 being lockable by a sleeve member 160 when slid along the member 116 to cover the hinge 124. Referring to FIG. 7, each end of the bracing member 116 has an integral bush 161 which can rotate and slide on the stud 156. A coil spring 162 seated inside the bush 161 and acting against the base of the U-shaped member 154, urges the bush towards a transverse pin 163 which projects on opposite sides of the stub 156 when fitted therein. Notches 164 in the rearwardly facing edge of the bush 161 allow the bush to move rearwardly when the bracing member 116 reaches the position relative to the support member corresponding to the operative state of the frame. Thus the notches 164 engage the pin 163 to locate bracing member in the operative position. The engagement is released by pushing the member 116 forward. This feature aids unfolding of the frame into the operative state.

Figure 8:
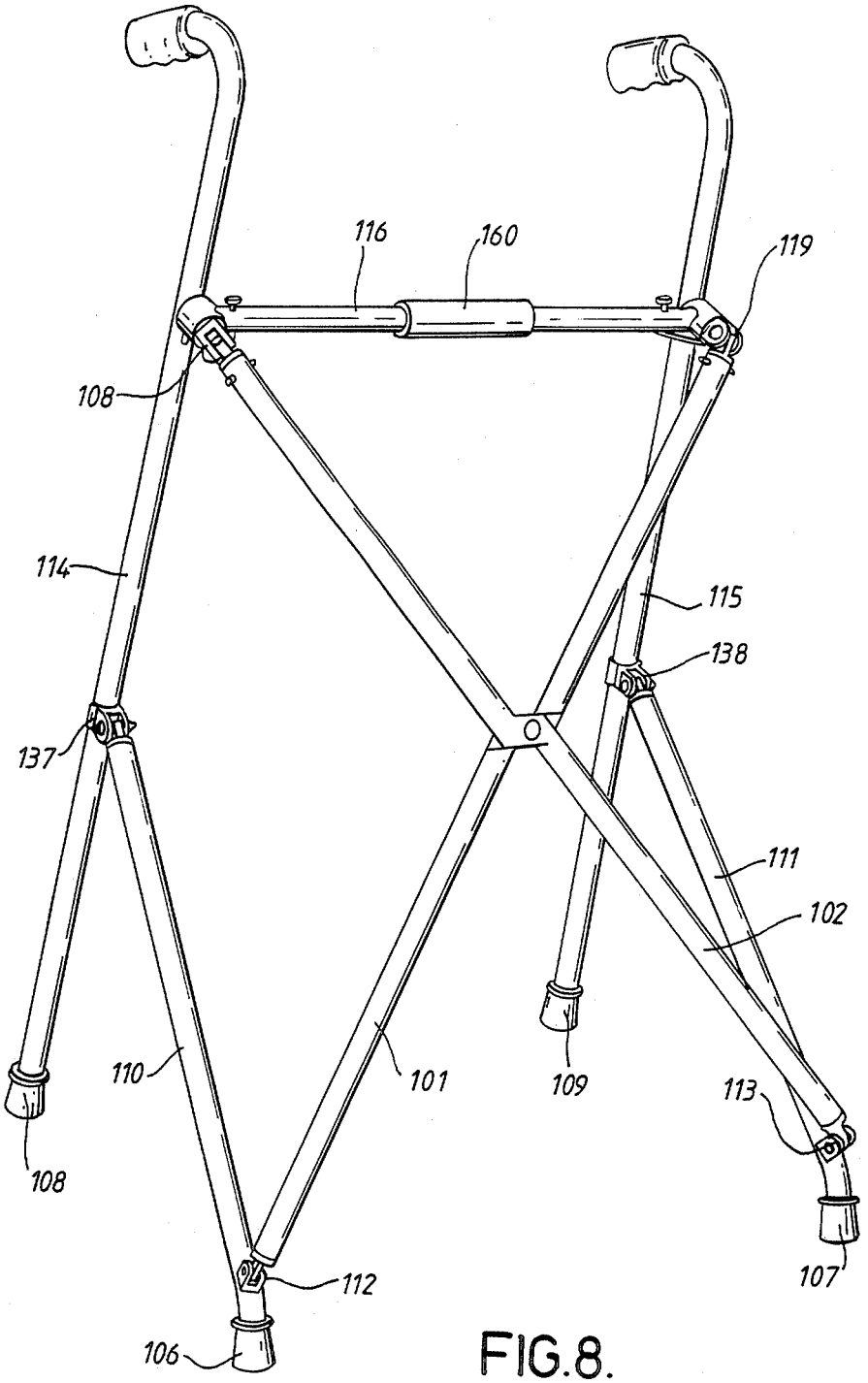
FIG. 8 is a perspective view of a further embodiment in accordance with the invention, shown in its operative state.

It will be appreciated that modifications can be made to the frame of FIGS. 4 and 5 within the scope of the present invention. A further embodiment including some such modifications is shown in FIG. 8. This frame is similar to that of FIGS. 4 and 5, and the reference in FIG. 8 correspond to those of FIG. 4. The two modifications incorporated in the frame of FIG. 8 lie in the arrangement of the front feet 106 and 107 which in this case are attached to extended bracing struts 110 and 111, and in the connection of the bracing member 116 to the rear support members 114 and 115. These features are shown in more detail in FIGS. 9 and 10 respectively.

Figure 9:
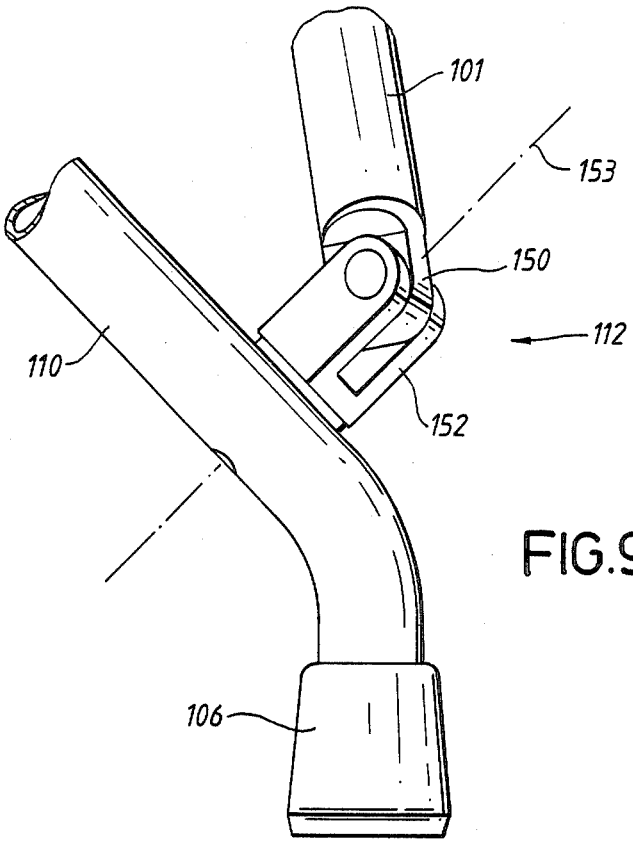
FIG. 9 is a side view of the alternative foot of the embodiment of FIG. 5.

Referring firstly to FIG. 9, which is a detail of the frame in the region of the right hand front foot 106, the scissor member 101 terminates at the hinged connection 112, the foot 106 now being mounted on a curved end portion of the bracing member 110. When in the operative state, the foot 106 of this embodiment stands squarely on the supporting surface. It also provides a marginal additional compactness in that the foot 106 tucks under the rear foot 108 when the frame is collapsed.

Figure 10:
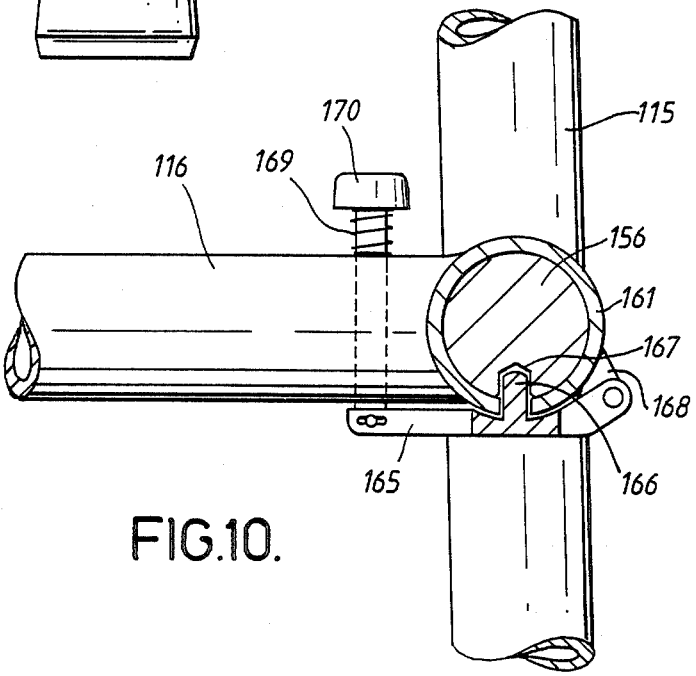
FIG. 10 is a sectioned front view of a hinged joint of the embodiment of FIG. 8.

The mechanism shown in FIG. 10 function similarly to that of FIG. 7 but differs in the manner in which the bracing member 116 is located relative to the support member 115 and in which the locating means is released. As before, the bracing member 116 has an integral bush 161 which rotates on the stub 156. Both the bush and the stub are sectioned in FIG. 10 immediately forward of the member 116. The means for locating the member 116 comprises a pivotable arm 165 with a pin 166 received in a hole in the bush 161 and engaging a recess 167 bored in the stub 156 when the member 116 is in its operative position. The arm 165 pivots on a lug 168 projecting from the bush 161 and is biased towards the stub 156 by a spring 169 acting against a release button 170 connected to the arm 165.

What is claimed is:

1. A collapsible walking frame for supporting a handicapped person while such person is walking and standing, comprising:

a pair of elongate front support members having upper and lower ends, said front support members being attached to each other at locations between their respective upper and lower ends by a pivot joint for allowing the members to be pivoted relative to each other in a scissor action;

a pair of upper pivotal connecting joints operatively connected to respective of said front support members in the region of upper ends of said front support member;

a pair of elongate rear support members having upper and lower ends, said rear support members, in an operative condition of the frame, being spaced apart from each other laterally of the frame and being located at an acute angle to said front support members, said upper ends of said rear support members each being coupled to a respective one of said front support members by a respective one of said pivotal connecting joints;

a pair of side bracing members on respective opposite sides of the frame and each having a front end portion pivotally connected to one of front support members below said pivot joint and a rear end portion pivotally connected on the same side of the frame to one of the rear support members at a location below and spaced from said upper pivotal connecting joints;

pivoted lockable bracing means connecting transversally between respective upper portions of said rear support members for holding the rear support members in their spaced apart relationship in said operative condition of the frame;

handle means operatively connected to respective upper ends of one of said pairs of said support members for supporting the person and for transmitting a downwardly directed load to the upper parts of said front support members and said rear members;

front ground-engaging support elements operatively connected to said front support members for receiving load forces transmitted from said handle means through said front support members; and rear ground-engaging support elements operatively connected to said rear support members for receiving load forces transmitted from said handle means through said rear support members;

the lengths of aid support members and the relative location of said handle means and said support elements being such that an imaginary plane through said handle means and normal to an imaginary ground engagement plane containing all of said support elements intersects said ground engagement plane between said front support elements and said rear support elements; and said front support members and said rear support members being so connected by said joints, bracing members and bracing means that their lower ends move towards each other when the frame is collapsed from its operative position until the front support members lie generally parallel to each other and adjacent the rear support members.

2. A walking frame according to claim 1, wherein said front and rear support elements are resilient feet.

3. A walking frame according to claim 1, wherein said support elements, in the operative condition of the frame, lie in a ground plane, and wherein a plane perpendicular to said ground plane and passing through said handles intersects said ground plane between the support elements.

4. A walking frame according to claim 1, wherein said side bracing members constitute the sole structural connection between the front support member and the rear support members below said upper pivotal connecting joints.

5. A collapsible walking frame for supporting a handicapped person while such person is walking or standing, comprising;

a pair of elongate front support members having upper and lower end portions, these front support members being attached to each other at locations between their respective upper and lower portions by a pivot joint for allowing said members to be pivoted relative to each other about an axis substantially perpendicular to said front support members between an operative configuration in which they form an 'X' and a collapsed condition in which they are substantially parallel;

a pair of elongate rear support members each having an upper end portion pivotally attached to an upper end portion of a respective one of said front support members, the lower end portions of said rear support members being spaced from the lower end portions of said front support members in the operative condition of the frame;

pivoted bracing means connecting transversally between respective upper end portions of said rear support members including locking means for holding said rear support members in a spaced configuration in the operative condition of the frame;

a pair of side bracing members pivotally connecting said front support members with said rear support members at locations below and spaced from said locations of said pivotal attachment of said upper end portions of said support members;

handle means connected to the upper end portions of the support members of at least one of said pairs of support members;

front ground-engaging support elements operatively connected to said lower end portions of said front support members and arranged to receive downwardly directed load forces transmitted by said front support members from said handle means; and rear ground-engaging support elements operatively connected to said lower end portions of said rear support members and arranged to receive downwardly directed load forces transmitted by said rear support members from said handle means;

said lower portions of said rear support members and said side bracing members defining the perimeter of a substantially unobstructed space for the user's legs.

6. A walking frame according to claim 5, wherein said front support members, rear support members and side bracing members all lie substantially parallel to each other when the frame is in a collapsed condition.

7. A walking frame according to claim 5, wherein said pivoted bracing means is a cross brace pivotally connected to the upper end portions of the rear support members and has a central pivotal joint.

8. A collapsible walking frame for supporting a handicapped person while standing or walking, comprising:

(i) a pair of front support members each having an upper end and a lower end;

(ii) a scissor joint located on said front support members at a point between and spaced from their respective upper and lower ends so that one of said front support members is pivotable scissor-wise with respect to the other of said front support members between a first position in which said members are generally parallel and located alongside each other and a second position in which they form a cross and define a first plane;

(iii) a pair of rear support members each having an upper end and a lower end;

(iv) first hinge means connected to said one front support member and to one of said rear support members in the vicinity of their upper ends, whereby said one rear support member is pivotally attached about at least one axis of rotation to said one front support member for relative movement of their respective lower ends towards and away from each other;

(v) second hinge means connected to said other front support member and to the other of said rear support members in the vicinity of their upper ends, whreby said other rear support member is pivotally attached about at least one axis of rotation to said other front support member for relative movement of their respective lower ends towards and away from each other;

(vi) a first side member having first front and rear pivotal connection means thereon in the vicinity of each of its ends, the front pivotal connection means being attached to a lower end portion of said one front support member about at least one axis of rotation, and the rear pivotal connection means being attached about at least one axis of rotation to said other rear support member at a point below and spaced from said second hinge means;

(vii) a second side member having a second front and rear pivotal connection means thereon in the vicinity of each of the ends, the second front pivotal connection means being attached to a lower end portion of each other front support member about at least one axis of rotation, and the second rear pivotal connection means being attached about at least one axis of rotation to said one rear support member at a point below and spaced from said first hinge means;

the arrangement of said side members, said hinge means and said pivotal connection means being such that when said front support members are in their first position alongside each other, said rear support members and said side members are also generally parallel to and lie alongside said front support members to form a compact, elongate collapsed assembly, and when said front support members are in their second position the rear support members are spaced apart from each other with an unobstructed space betrween lower end portions thereof and define a second plane which intersects said first plane in the region of said hinge means and is at an acute angle to said first plane;

the frame further comprising:

(viii) first and second handle means coupled to respective upper ends of one of said pairs of support members;

(ix) first and second front ground engagement means coupled to either respective ones of said front support members or to said side support members;

(x) first and second rear ground engagement means coupled to respective lower ends of said rear support members; and (xi) releasable locking means coupled between at least two of the elements of the frame which must move relative to each other when said frame is to be collapsed from said open configuration, said locking means being arranged to prevent such movement unless released;

said front and rear ground engagement means defining a third plane which intersects said first and second planes when said front support members are in their second position, and said first and second handle means and said ground engagement means being located such that lines through respective ones of said handle means and perpendicular to said third plane intersect said third plane at points between the front ground engagement means and the rear ground engagement means.

9. A collapsible walking frame according to claim 8, wherein the front and rear ground engagement means are non-rolling.

10. A collapsible walking frame according to claim 8, wherein the locking means comprises collapsible transverse bracing means coupled to the first and second hinge means.

11. A collapsible walking frame according to claim 8, wherein the first and second hinge means each define a plurality of pivot axes.

12. A collapsible walking frame according to claim 8, wherein the ground engagement means comprise four rubber feet.

13. A collapsible walking frame according to claim 8, wherein the first and second handle means are upward extensions of the rear support members above the first and second hinge means.

14. A collapsible walking frame according to claim 8 wherein the first and second front ground engagement means is coupled to the lower ends of said front support members.

15. A collapsible walking frame according to claim 8 wherein the first and second front ground engagement means is coupled to bent down forward ends of said side support members.

* * * * *